United States Patent [19]

Reiling, Jr. et al.

[11] Patent Number: 4,906,215

[45] Date of Patent: Mar. 6, 1990

[54] TOY COMBINATION OF TOY ARTICLE AND TOY ATTACHMENTS

[75] Inventors: Victor G. Reiling, Jr., West Cornwall; Brian L. Dean, Torrington, both of Conn.; D. Michael Ledyard, Grosse Pointe, Mich.; Daniel J. Cooney, Birmingham, Mich.; John W. Brady, Utica, Mich.

[73] Assignee: Lionel Trains, Inc., Mt. Clemens, Mich.

[21] Appl. No.: 120,613

[22] Filed: Nov. 13, 1987

[51] Int. Cl.[4] ..... A63H 17/00

[52] U.S. Cl. ..... 446/94; 446/121; 446/279

[58] Field of Search ..... 446/85, 93–95, 446/97, 99, 101, 120, 121, 124, 268, 275, 279, 288, 433, 462, 465, 470, 471

[56] References Cited

U.S. PATENT DOCUMENTS

| | | | |
|---|---|---|---|
| 2,044,735 | 6/1936 | Pelton | 446/90 |
| 2,487,654 | 11/1949 | Hoffman et al. | 446/121 X |
| 3,477,167 | 11/1969 | Ach | 446/120 X |
| 3,553,887 | 1/1971 | Linstead | 446/471 |
| 3,597,873 | 8/1971 | Fischer . | |
| 3,634,965 | 1/1972 | McAuley | 446/88 |
| 3,659,378 | 8/1972 | Tong . | |
| 3,740,895 | 6/1973 | Nagasaka . | |
| 3,774,339 | 11/1973 | Swett | 446/121 |
| 3,811,218 | 5/1974 | Salmon et al. . | |
| 3,826,039 | 7/1974 | Disko et al. . | |
| 4,132,028 | 1/1979 | Ogawa . | |
| 4,183,173 | 1/1980 | Ogawa | 446/94 |
| 4,189,864 | 2/1980 | Saito . | |
| 4,248,006 | 2/1981 | Jones et al. . | |
| 4,470,219 | 9/1984 | Sugimoto | 446/464 |
| 4,504,239 | 3/1985 | Kulesza et al. | 446/95 |
| 4,505,265 | 3/1985 | Crongnwett et al. | 446/95 X |
| 4,571,202 | 2/1986 | Diebold | 446/90 |

FOREIGN PATENT DOCUMENTS

| | | | |
|---|---|---|---|
| 0085542 | 8/1983 | European Pat. Off. | 446/93 |
| 1221962 | 6/1960 | France | 446/94 |

*Primary Examiner*—Mickey Yu

*Attorney, Agent, or Firm*—Edward J. Timmer

[57] ABSTRACT

The toy combination includes a toy vehicle having one or more pairs of spaced apart shoulders on exterior sides of the vehicle body and one or more toy attachments releasably secured on the pairs of shoulders by snap-fitting a respective pair of rails on the toy attachment against a respective pair of shoulders. The toy attachment includes resilient extensions on which the rails are carried. The extensions are flexed to snap-fit the rails on the shoulders. The toy attachment can include first and second pairs of extensions adjacent opposite ends with a receptacle intermediate the extensions for releasably receiving a toy figure.

27 Claims, 3 Drawing Sheets

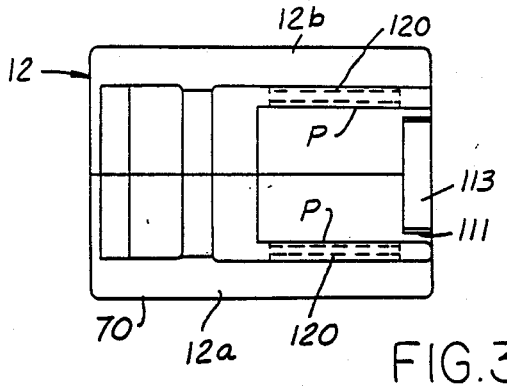
FIG. 1
FIG. 2
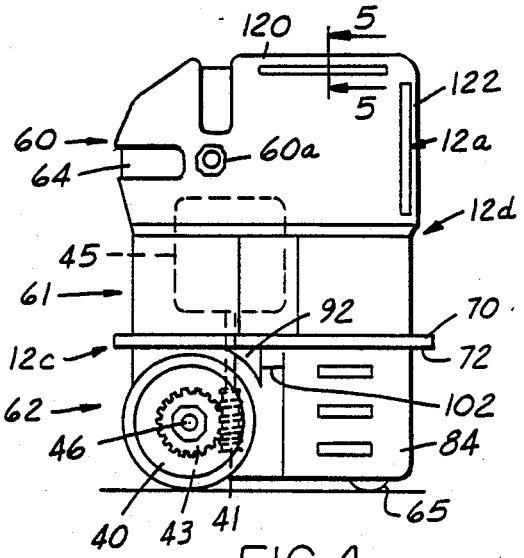
FIG. 3
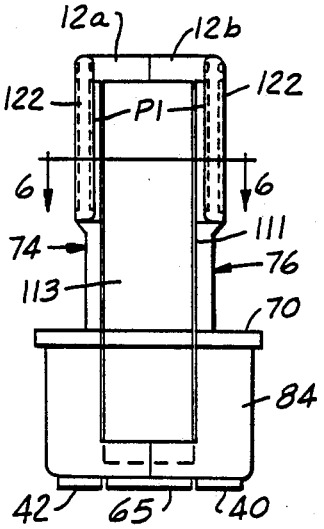
FIG. 4
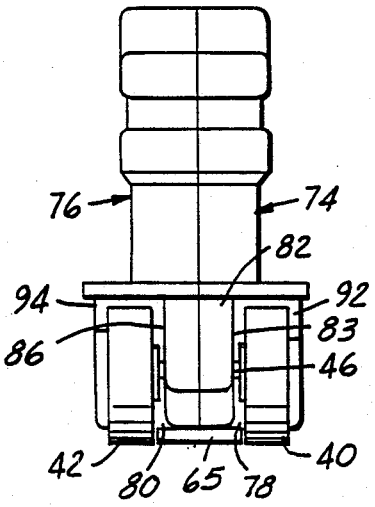
FIG. 5
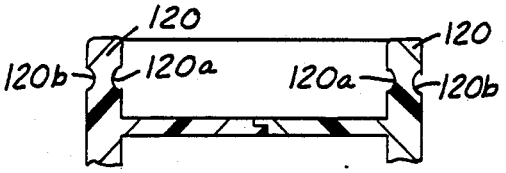
FIG. 6
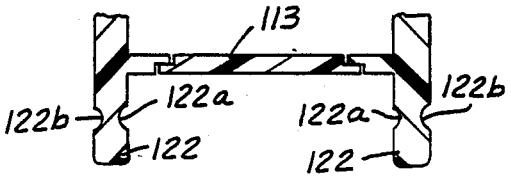

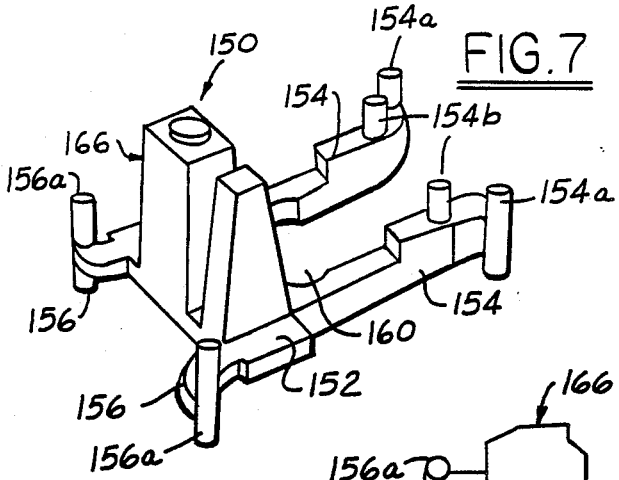
FIG.7
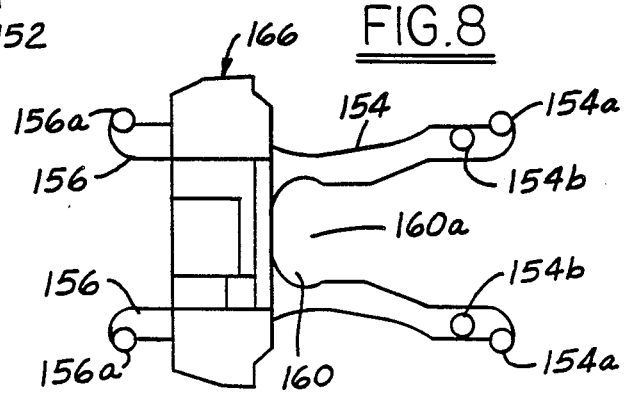
FIG.8
FIG.9
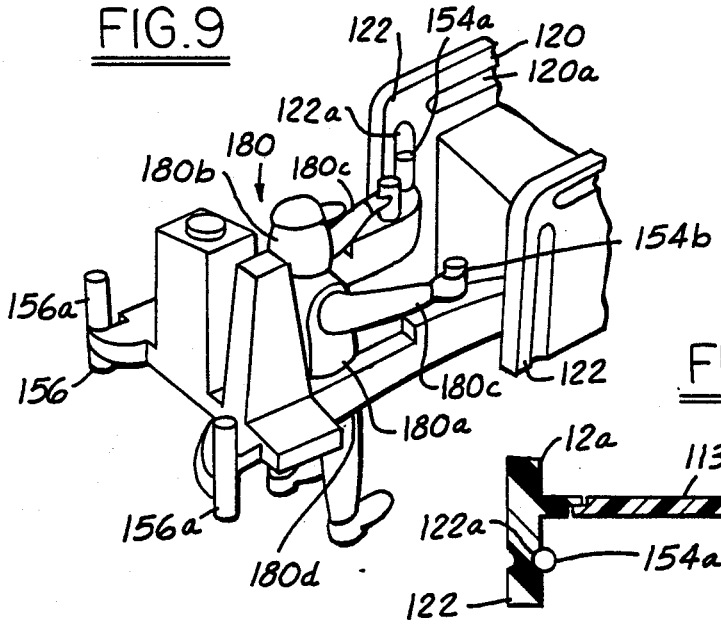
FIG.10
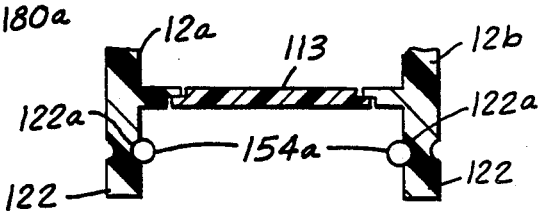

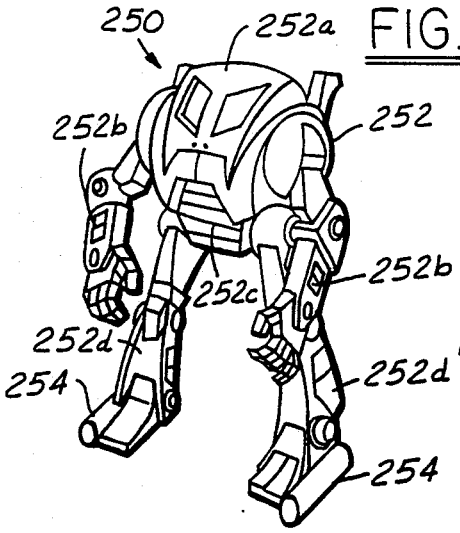
FIG. 11
FIG. 12
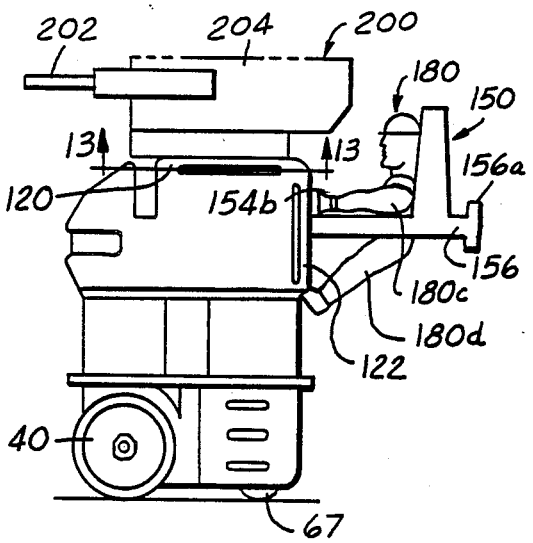
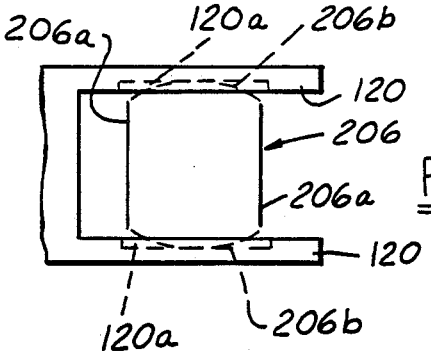
FIG. 13

TOY COMBINATION OF TOY ARTICLE AND TOY ATTACHMENTS

FIELD OF THE INVENTION

The invention relates to a toy combination including a toy article such as a toy vehicle and one or more toy attachments releasably secured together.

BACKGROUND OF THE INVENTION

The Fischer U.S. patent (U.S. Pat. No. 3,597,873 issued Aug. 10, 1971) shows a toy construction kit including a series of connectable structural elements using coupling heads and coupling grooves to interconnect pieces. The patent is particularly directed to a non-wheeled drive unit which may be integrally coupled with the structure using such connector elements. The drive unit includes a worm gear for driving purposes.

The Tong U.S. patent (U.S. Pat. No. 3,659,378 issued May 2, 1972) shows a motor driven toy vehicle which may use different vehicle bodies connected to a suitable power module. The power module has an output drive gear to drive the wheels of the vehicle through a driven gear on the axle. The power module is received in the bottom of the vehicle body.

The Nagasaka U.S. patent (U.S. Pat. No. 3,740,895 issued June 26, 1973) shows an amusement device including a plurality of toy figures which may be coupled directly to a two-wheeled vehicle and coupled one on top of each other. The vehicle is in the form of a motorcycle having front and back wheels with a motor, gear train and battery between the wheels.

The U.S. patent to Salmon et al (U.S. Pat. No. 3,811,218 issued May 21, 1974) relates to a modular toy vehicle including various assemblies and sub-assemblies which may be taken apart and reassembled using various coupling means.

The Disko et al U.S. patent (U.S. Pat. No. 3,826,039 issued July 30, 1974) discloses a toy vehicle having a plurality of interchangeable shell accessories which are connected to the driven chassis of the toy.

The U.S. patent to Ogawa (U.S. Pat. No. 4,132,028 issued Jan. 2, 1979) shows a toy assembly having interchangeable parts and detachable appendages.

The Saito U.S. patent (U.S. Pat. No. 4,189,864 issued Feb. 26, 1980) relates to a self-powered four-wheeled toy vehicle chassis which is capable of sequentially receiving and rejecting a plurality of different types of vehicles bodies.

The U.S. patent to Jones et al (U.S. Pat. No. 4,248,006 issued Feb. 3, 1981) is directed to a reconfigurable toy including an electrically driven body section having driven tracks and a plurality of accessories which are interchangeably connected to form various play units.

The Sugimoto U.S. patent (U.S. Pat. No. 4,470,219 issued Sept. 11, 1984) relates to a toy vehicle assembly including a chassis member, a prime mover assembly and a body which are interconnectable to accommodate various different forms of vehicle bodies. The prime mover assembly includes a pair of rear wheels and a spring motor for driving the rear wheels.

The U.S. patent to Kulesza et al (U.S. Pat. No. 4,504,239 issued Mar. 12, 1985) discloses a self-propelled power driven land four-wheeled vehicle including a power take-off friction coupling to drive a helicopter shell accessory. The four wheels of the land vehicle are exposed when the land vehicle is combined with the helicopter. The land vehicle and helicopter include parallel rails and channels in engagement to hold them together and a latch and trigger mechanism to release the vehicle from the helicopter.

The U.S. patent to Diebold (U.S. Pat. No. 4,571,202 issued Feb. 18, 1986 is directed to an electrically powered modular toy set including a motorized main vehicle and accessory unit. The accessory unit is motorized through an electrical connection between the main vehicle and the accessory. Vehicle components are releasably mounted on the main vehicle.

SUMMARY OF THE INVENTION

The invention contemplates a toy combination including a toy article such as a toy vehicle and toy attachment thereon wherein the toy attachment includes a pair of extensions and a rail on each extension for releasably engaging, preferably snap-fitting, onto a respective one of a pair of spaced apart shoulders on the toy article.

The invention also contemplates a toy combination of the type described wherein the toy article includes two pairs of spaced apart shoulders with one pair extending transverse to the other and a first toy attachment and second toy attachment releasably engaged to a respective pair of the shoulders with the toy attachments preferably cooperatively positioned for example to give the appearance that one toy attachment is operating or controlling the other.

The invention further contemplates a toy attachment having a body with a pair of resilient extensions adjacent an end of the body and having a rail on each extension and with a receptacle between the extensions for receiving a toy figure. The toy attachment is releasably engageable to a toy article by means of the pair of rails formed on the extensions. The toy attachment in a preferred embodiment may include first and second pairs of extensions extending from opposite ends of the body with the receptacle intermediate the ends.

In a typical working embodiment of the invention, a toy article includes a toy vehicle having a bottom side with wheels thereon, a top exterior side having a first pair of spaced apart parallel shoulders and another exterior side transverse to the top side, such as the rear side, having a second pair of spaced apart parallel shoulders extending transverse to the first pair. A toy attachment includes a plastic body having first and second pairs of resilient extensions extending from opposite ends. The extensions each have a rail thereon so that first and second pairs of rails are provided on opposite ends of the body. Either pair of rails may be snap-fit between either the first or second pair of shoulders by flexing the respective extensions on which the rails are carried. A toy figure having a head, arms, waist and legs is releasably received with its waist in a receptacle intermediate the first and second pair of extensions. The arms of the toy figure are adapted to extend to a third pair of rails on one of the first or second pair of extensions to grip the third pair of rails in a manner to simulate control handles for the toy attachment. This toy attachment may be snap-fit on the pair of shoulders on the rear side of the toy vehicle.

Another toy attachment may be snap-fit on the pair of shoulders on the top side and positioned to cooperate at least visually with the toy attachment having the toy figure in the receptacle. For example, the toy attachment on the top side may take the form of a weapon that is being operated by the toy figure of the toy attachment snap-fit on the rear side. The weapon attachment may be attached between the shoulders on the top side by interference fit or snap-fit.

BRIEF DESCRIPTION OF THE DRAWINGS

FIG. 1 is a plan view of a toy vehicle useable in the toy combination of the invention.

FIG. 2 is an elevation of the toy vehicle of FIG. 1.

FIG. 3 is an end (rear) elevation of the toy vehicle.

FIG. 4 is an end (front) elevation of the toy vehicle.

FIG. 5 is a partial section taken along lines 5—5 of FIG. 2.

FIG. 6 is a partial section taken along lines 6—6 of FIG. 3.

FIG. 7 is a perspective view of a toy attachment of the invention.

FIG. 8 is a plan view of the toy attachment of FIG. 7.

FIG. 9 is a partial perspective view of the toy vehicle with the toy attachment snap-fit thereon.

FIG. 10 is a section through the rails of the toy attachment and shoulders of the toy vehicle of FIG. 9 showing engagement therebetween.

FIG. 11 is a perspective view of another toy attachment of the invention.

FIG. 12 is an elevation of the toy vehicle of FIG. 2 having the toy attachment of FIG. 7 and a weapon attachment connected thereon.

FIG. 13 is a view taken along lines 13—13 of FIG. 12.

BEST MODE FOR PRACTICING THE INVENTION

Referring to FIGS. 1–4, a toy vehicle 10 of the invention is shown including an upstanding body 12 comprised of first and second halves **12*a*,12*b*. Halves 12*a*,12*b*** can be molded plastic and screwed or otherwise joined together in known fashion, although the invention is not so limited.

The toy vehicle 10 includes an outer configuration defining a general mechanical or machine robot shape having an upper head-like portion 60, intermediate waist portion 61 and a lower wheeled portion 62. Head-like portion 60 carries a translucent lens or plate 64 to simulate a visual sensor on the head-like portion. Head-like portion 60 also includes octagonal recesses **60*a*** on opposite sides to releasably receive in friction fit octagonal male protrusions (not shown) on a toy attachment (not shown).

Wheeled portion 62 includes a pair of front wheels 40,42 mounted on axle 46 that is driven in rotation by a worm 41 and worm gear 43 constituting a drive train and electrical motor 45 disposed in the body 12. Additional description of the driven train and motor to rotate axle 46 is found in copending application entitled "Powered Toy Vehicle Mateable With Other Toy Articles" of common assignee herewith, the teachings of which are incorporated herein by reference.

Although not essential to practicing the invention, wheeled portion 62 also preferably includes a non-driven freely rotatable rear roller wheel 6 disposed rotatably between body halves **12*a*,12*b* and having one axle end that is pivotal relative to the other axle end. Such a roller wheel is described in copending application entitled "Toy Vehicle With Pivotable Fifth Wheel" filed in the name of D. Michael Ledyard as inventor and of common assignee, the teachings of which are incorporated by reference. Alternately, rear wheel 65 may simply be a freely rotating wheel that does not include a pivoting axle and instead has an axle having an axis of rotation maintained at all times parallel to that of front axle 36** and the front wheels thereon.

Separating the waist portion 61 and lower wheeled portion 62 is a horizontal flange 70 extending around the periphery of the body 12 above wheels 40,42. Flange 70 projects laterally from the portion 62 normal to the long axis (height) of body 12 to form a laterally extending shoulder 72 on its underside. Flange 70 preferably is molded integrally with halves **12*a*,12*b*. In lieu of a projecting flange defining a laterally extending shoulder 72, the shoulder may be formed on the opposite first and second sides 74,76 of the vehicle body 12; e.g., by molding the shoulder in or under overhanging portions of sides 74,76**.

As is apparent, opposite first and second sides 74,76 form the lateral sides of the robot. Front side recesses 78,80 are formed in sides 74,76 to receive the wheels 40,42, respectively. To this end, the lower wheeled portion 62 includes a relatively narrow front compartment 82 between the wheels in which compartment the aforementioned worm/worm gear drive train and electrical motor are received. Front compartment 82 includes opposite parallel front sides 83,86 defining a respective recess 78,80.

Behind the narrow front compartment 82 is a relatively large rear compartment 84 in which the lower end of an upstanding battery (not shown) is disposed to power the electrical motor.

As shown best in FIG. 2, a wheel cowl portion 92,94 is molded on each front side 83,86, respectively, behind respective wheel 40,42. Each cowl portion 92,94 includes a vertical wall in spaced parallel relation to respective vertical walls of compartment 84 to define an upstanding, preferably vertical, channel (only channel 102 shown) on opposite sides 74,76, respectively, to the rear of respective recess 78,80. The channels are open at the bottom and are closed at the upper end by shoulder 72 with which the channels intersect in a perpendicular manner. Although not essential to practicing the invention, the channels form locating means on the vehicle body for purposes explained in aforementioned copending application entitled "Powered Toy Vehicle Mateable With Other Toy Articles", the teachings of which are incorporated herein by reference. The channels and other features of the toy vehicle are described in greater detail in that copending application.

In accordance with the invention, toy vehicle 10 includes a first pair of spaced apart parallel shoulders 120 and 122. Shoulders 120,122 are molded integrally With the body halves **12*a*,12*b*. First pair of shoulders 120 are disposed on the top side of the toy vehicle whereas second pair of shoulders 122** are disposed on the rear side thereof.

Shoulders 120 extend longitudinally on the top side between the front **12*c* and rear 12*d* of the vehicle. Shoulders 122 extend longitudinally on the rear side between the top and bottom of the vehicle. Shoulders 120 thus extend transverse to shoulders 122. If extended, shoulders 120 and 122** would intersect one another at a right angle.

Shoulders 122 are disposed on opposite sides of the opening 111 in the rear side through which the battery (not shown) is inserted and closed off by the door 113 snap-fit on the rear side.

As shown in FIGS. 5 and 6, each shoulder includes a respective elongate open-sided shallow recess **120*a*,122*a* on inner facing sides of the shoulders 120,122, respectively, and similar elongate open-sided shallow recesses 120a,120b** on outer sides of the shoulders.

Recesses 120a,120b,122a,122b have a circular arc profile or contour for reasons to be explained, although other profiles can be used.

As is apparent from FIG. 1, inner facing sides of shoulders 120 define longitudinally extending planes P that are parallel with one another. Similarly, inner facing sides of shoulders 122 define longitudinally extending planes P1 that are parallel with one another. The outer sides of shoulders 120 and 122 similarly define longitudinally extending planes that are parallel with planes P and P1, respectively.

A toy attachment 150 for releasable attachment on shoulders 120,122 is shown in FIGS. 7 and 8. The toy attachment includes plastic body 152 having a first and second pair of extensions 154,156 extending from forward and rearward ends of the body, respectively. Each extension includes an elongate cylindrical rail 154a,156a, respectively. As shown, rails 154a on extensions 154 have parallel longitudinal axes. Rails 156a similarly have longitudinal axes parallel to one another and also to the longitudinal axes of rails 154a. Rails 154a are molded on the extensions 154 near the forwardmost ends thereof while rails 156a are molded near the rearwardmost ends of extensions 156.

A receptacle 160 is positioned intermediate extensions 154,156 and includes an open side 160a opening forwardly between forward extensions 154. Receptacle has a circular profile whose axis is parallel with the longitudinal axes of rails 154a,156a.

Forwardly of receptacle 160 on extensions 154 is a third pair of rails 154b whose longitudinal axes are parallel with those of rails 154a,156a. Rails 154b extend upwardly from extensions 154 whereas rails 154a and 156a extend upwardly and downwardly of the respective extensions 154,156.

Behind receptacle 160 is a molded upstanding compartment 166 that is configured to simulate a power source such as a jet pack by which the toy attachment 150 can be propelled.

A toy figure 180 includes a waist 180a, releasably received in the receptacle 160 as shown in FIG. 9. Toy figure 180 also includes a head 180b, pair of arms 180c and legs 180d. The arms and legs are articulated so that a child can move them when the toy figure is received in the receptacle.

In particular, the arms 180c can be articulated to the position shown in FIG. 9 so that the hands thereon can grip the third set of rails 154b which thus simulate control grips by which jet pack 166 is controlled by the toy figure. Legs 180d may depend downwardly or may be articulated at an angle to vertical as shown in FIG. 12.

As shown in FIG. 9, toy attachment 150 with the toy figure 180 in receptacle 160 can be releasably engaged between rear shoulders 122 with forward rails 154a received in facing open-sided recesses 122a. Rails 154a are snap-fit into recesses 122a by flexing forward extensions 154 inwardly toward one another and positioning the rails 154a between shoulders 122 and then releasing the extensions to allow resiliency of the extensions to snap-fit the rails outwardly toward the respective rear shoulder 122 with a respective rail 154a received in a respective recess 122a as shown in FIG. 10. Resiliency of extensions 154,156 is selected and controlled to this end. From FIG. 1 it is clear that resiliency of extensions 154 causes rails 154a to move outwardly transverse to planes P defined by the facing sides of shoulders 122 for receipt in the adjacent open-sided recesses. Recesses have open sides to this end. Toy figure 180 faces forwardly when rails 154a are snap-fit on shoulders 122 as shown.

Of course, rear rails 156a can be snap-fit in recesses 122a of shoulders 122 so as to position the toy figure 180 in a rearwardly facing direction on toy vehicle 10.

The child playing with the toy combination thus has several alternatives for mating the toy attachment 150 with toy vehicle 10.

In FIG. 12, a second toy attachment 200 in the form of a weapon having gun 202 and body 204 is shown releasably engaged between shoulders 120. In particular, body 204 includes a depending attachment projection 206 having parallel planar sides 206a spaced apart a distance less than the spacing between shoulders 120 and having arcuate sides 206b that at their widest are spaced a distance slightly greater than the spacing between shoulders 120, Weapon attachment 200 is releasably engaged between shoulders 120 by inserting projection 206 between the shoulders 120 with sides 206a parallel to the shoulders and then rotating the weapon attachment to cause arcuate sides 206b to enter and engage in friction fit in facing recesses 120a as shown in FIG. 13.

In FIG. 12, weapon attachment 200 is releasably engaged between shoulders 120 with the gun facing forwardly and toy attachment 150 is releasably engaged between shoulders 122 with toy figure 180 extending forwardly and the hands thereon on control rails 154b. Legs 180d of the toy figure are articulated at an angle to vertical so that the feet abut against rear 12d of the toy vehicle as shown. As is apparent, toy attachments 200 and 150 are cooperatively positioned to give the appearance that toy figure 180 is also controlling or operating the weapon attachment 200 on the top side of the vehicle 10.

Of course, other toy attachments can be used in combination with toy vehicle 10. Another such toy attachment 250 is illustrated in FIG. 11 as a toy robot figure 252 having a head 252a arms 252b, body with waist 252c and legs 252d. Legs 252d each include an elongate cylindrical rail 254 by which the toy figure can be attached on shoulders 120 or 122 as the child desires. Legs 252d are articulated and outwardly biased on the body of the toy figure to this end. Thus, legs 252d are flexed inwardly toward one another to position rails 254 between shoulders 120 or 122 and then released to bias the rails 254 outwardly away from one another toward the respective shoulder for receipt in a respective recess; e.g., as shown in FIG. 10 for rails 154a of the toy attachment 150. Rails 254 are positioned in parallel relation prior to snap-fitting on the shoulder on toy vehicle 10.

Alternatively, legs 252d may be articulated but not outwardly biased and rails 254 can be sized to effect interference fit in recesses 120a,120b,122a, or 122b to releasably engage the toy figure 250 on shoulders 120 or 122.

Of course, multiple toy figures 250 and/or toy attachments 150,200 can be releasably engaged on shoulders 120 and 122. This provides the child with a wide variety of toy combinations to make and with which to play.

Although shoulders 120,122 are illustrated on the top and rear sides of toy vehicle 10, those skilled in the art will appreciate that similar shoulders may be provided on other of the sides of the toy vehicle.

Although toy attachments 150, 200 and 250 have been illustrated, those skilled in the art will appreciate that numerous other forms of toy attachments can be used and combined with toy vehicle 10 in the manner described hereinabove.

Although the toy article of the invention has been illustrated as a toy vehicle 10, those skilled in the art will appreciate that the toy article may include other forms such as for example a toy trailer for coupling with the toy vehicle for towing thereby, a toy command building, toy house or other forms.

Thus, while the invention has been described by a detailed description of certain specific and preferred embodiments, it is understood that various modifications and changes can be made in them within the scope of the appended claims which are intended to include equivalents of such embodiments.

We claim:

1. A toy combination comprising:

(a) a toy article having a pair of spaced apart shoulders on an external surface thereof, (b) a first toy attachment having a pair of spaced apart extensions and a rail on each extension with each rail releasably engaging onto a respective one of the shoulders to releasably secure the toy attachment on the toy article, said toy attachment having a receptacle disposed between said extensions, and (c) a second toy attachment having a portion releasably received in said receptacle.

2. The combination of claim 1 wherein the extensions are resilient to releasably snap-fit each rail onto a respective one of the shoulders.

3. The combination of claim 1 wherein the shoulders are substantially parallel.

4. The combination of claim 2 wherein the rails are substantially parallel on the first toy attachment.

5. The combination of claim 1 wherein the shoulders each include an elongate open-sided recess facing one another with a rail releasably received in a respective recess.

6. The combination of claim 1 wherein the toy article includes two pairs of spaced apart shoulders with one pair extending transverse to the other.

7. The combination of claim 1 wherein the first toy attachment includes two pairs of extensions with one pair adjacent each end thereof.

8. The combination of claim 7 wherein the rails on the extensions are substantially parallel.

9. The combination of claim 7 wherein the first toy attachment includes said receptacle intermediate said pair of extensions to releasably receive said second toy attachment therein.

10. The combination of claim 9 wherein the receptacle is an open sided receptacle.

11. The combination of claim 1 wherein said second toy attachment includes a toy figure having body with a head, waist and legs and said waist is releasably received in the receptacle.

12. A toy combination comprising:

(a) a self-propelled article having a pair of spaced apart shoulders on an external surface thereof, (b) a toy attachment having a receptacle and first and second pairs of spaced apart extensions extending in opposite directions and having respective first and second pairs of rails thereon with the first or second pair of rails releasably engaging onto the pair of said shoulders, said receptacle being intermediate said first and second pairs of spaced apart extensions, and (c) a toy figure having a body releasably received in the receptacle.

13. The toy combination of claim 12 wherein the first and second pairs of rails are substantially parallel to one another.

14. The toy combination of claim 13 wherein the receptacle is defined around an axis that is substantially parallel with the first and second pairs of rails.

15. The toy combination of claim 13 wherein said toy attachment further includes a third pair of rails adjacent one of said first and second pair of rails to form a pair of grips for holding by arms of the toy figure when it is received in the receptacle.

16. The toy combination of claim 15 wherein the third pair of rails is substantially parallel with the first and second pairs of rails.

17. The toy combination of claim 12 wherein the rails are cylindrical in form.

18. A toy combination including a toy attachment comprising a body having a first pair of resilient extensions extending from an end of said body, each extension having a rail extending transversely therefrom to provide a pair of spaced apart, transversely extending rails spaced from said end of the body, said extensions having a receptacle between the extensions adjacent said body, and a toy figure having a waist portion releasably received in said receptacle between said extensions and having a pair of arms, each with a hand, extending toward said rails such that each hand engages a respective rail.

19. The toy combination of claim 18 wherein the body has first and second pairs of extensions extending from opposite ends of the body and the receptacle is intermediate the first and second pairs of extensions.

20. The toy combination of claim 18 wherein the receptacle includes an open side between said first pair of extensions.

21. The toy combination of claim 18 wherein the rails are substantially parallel with one another.

22. The toy combination of claim 18 wherein the rails extend substantially parallel to a major dimension of the body.

23. The toy combination of claim 18 wherein a second pair of rails is provided on a second pair of extensions, and said second pair of extensions extending from another end of said body.

24. The toy combination of claim 23 wherein a third pair of rails is provided on one of said first and second pair of extensions and is substantially parallel to said first and second pair of rails.

25. A toy combination comprising:

(a) a toy vehicle having a body with wheels, a bottom side, a top exterior side having a first pair of spaced apart substantially parallel shoulders extending between the front and rear of said top side, and another exterior side transverse to the top side, said another exterior side having a second pair of spaced apart, substantially parallel shoulders extending between the top and the bottom of said another exterior side transverse to said first pair of shoulders, (b) a first toy attachment releasably received on the first pair of shoulders, and (c) a second toy attachment having a pair of spaced apart extensions and a rail on each extension with each rail releasably received on the second pair of shoulders.

26. The toy combination of claim 25 where the first toy attachment resembles a weapon and the second toy attachment resembles a robot or human figure that appears to be operating the weapon.

27. The toy combination of claim 25 wherein said first pair of shoulders are formed on a first pair of flanges extending from the top side and said second pair of shoulders are formed on a second pair of flanges extending from said another exterior side.

* * * * *